US006593904B1

(12) United States Patent
März et al.

(10) Patent No.: US 6,593,904 B1
(45) Date of Patent: Jul. 15, 2003

(54) ACTIVE MATRIX LIQUID CRYSTAL DISPLAY

(75) Inventors: Michael März, Steinbach (DE); Klaus Wammes, Alsheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/623,541

(22) PCT Filed: Mar. 2, 1999

(86) PCT No.: PCT/DE99/00548

§ 371 (c)(1),
(2), (4) Date: Dec. 4, 2000

(87) PCT Pub. No.: WO99/45526

PCT Pub. Date: Sep. 10, 1999

(30) Foreign Application Priority Data

Mar. 3, 1998 (DE) ..... 198 08 982

(51) Int. Cl.[7] ..... G09G 3/36

(52) U.S. Cl. ..... 345/87; 345/89; 345/3.1; 345/690; 345/211; 345/210; 345/5; 345/428; 345/426

(58) Field of Search ..... 345/87, 89, 3.1, 345/690, 211, 210, 5, 426, 428

(56) References Cited

U.S. PATENT DOCUMENTS 4,635,127 A 1/1987 Togashi
5,250,937 A 10/1993 Kikuo et al.
5,489,918 A * 2/1996 Mosier ..... 345/89
5,526,065 A 6/1996 Todoriki
5,625,387 A 4/1997 Moon
5,926,157 A * 7/1999 Moon ..... 345/89

FOREIGN PATENT DOCUMENTS

DE 32 14 021 10/1983
EP 0 514 033 11/1992

* cited by examiner

*Primary Examiner*—Matthew C. Bella
*Assistant Examiner*—Tam Tran
(74) *Attorney, Agent, or Firm*—Kenyon & Kenyon

(57) ABSTRACT

In an active matrix liquid crystal display having liquid crystal cells arranged in rows and columns. One side of the liquid crystal cells is in contact with a common reference potential and it being possible to switch gray-scale signals through on the other side. In order to increase the voltage range within which the liquid crystal cells can be operated without distortion of the image rendering, a correction device is provided which distorts the gray-scale signals reaching the liquid crystal cell based on information concerning the typical dependence between the optical transparence of the liquid crystal cells and the voltage applied to them and as a function the potential difference between the gray-scale signals and the reference potential in such a way that an at least approximately linear relationship results between the optical transparence of the liquid crystal cells and the undistorted gray-scale signals.

6 Claims, 6 Drawing Sheets

ACTIVE MATRIX LIQUID CRYSTAL DISPLAY

FIELD OF THE INVENTION

The present invention relates to an active matrix liquid crystal display in which the pixels formed by liquid crystal cells are arranged in rows and columns of a matrix. One side of the liquid crystal cells is connected to a reference potential and the other side is connected column-by-column to column electrodes via controllable switches assigned to them individually. The switches are connected row-by-row to row electrodes on the control side. The column electrodes are connected to a column control unit generating various gray-scale signals for the different columns and the row electrodes are connected to a row control unit generating turn-on signals for the switches in the various rows. The terms rows and columns are interchangeable here as well as hereinafter.

BACKGROUND INFORMATION

Such an active matrix liquid crystal display which is also referred to as a TFT-LCD (thin film transistor liquid crystal display) due to the controllable switches commonly in the form of thin film transistors, is described in U.S. Pat. No. 4,635,127.

To display images with various gray-scale values, gray-scale signals are applied to the column electrodes, the gray-scale signals representing the gray-scale values of one row each; the gray-scale signals are switched through to the liquid crystal cells of the affected row via a turn-on signal at one of the row electrodes. In this manner, all rows having liquid crystal cells are activated in rapid succession. The optical transparence of each individual liquid crystal cell is set as a function of the voltage at the liquid crystal cell so that the desired image is displayed when there is background lighting of the active matrix liquid crystal display. To avoid gray-scale value corruptions in image rendering, the liquid crystal cells are operated in a voltage range in which the otherwise typically non-linear dependence between the transparence of the liquid crystal cells and the voltage applied to them is approximately linear.

For the display of color images, red, green and blue color filter color strips are arranged upstream or downstream from the liquid crystals alternatingly column-by-column, the three adjacent liquid crystal cells lying upstream or downstream in a row being combined into one color pixel made up of three subpixels as regards their activation. In rendering color images, non-linearities between the transparence of the liquid crystal cells and the voltage applied to them can have a particularly interfering influence.

The transparence of each individual liquid crystal cell occurring as a function of the applied voltage depends on the viewing angle due to the voltage-dependent optical twisting of the liquid crystal, so that with a specific voltage applied to the liquid crystal cell, the brightness of the displayed pixel varies as a function of the viewing angle of the observer.

This effect effect is used in liquid crystal displays which are designed only for bright/dark or black/white display, but not for displaying different brightness and gray-scale values. An example of this is the setting of optimum contrast ratios for a specific viewing angle. An additional example described U.S. Pat. No. 5,526,065 is the use of such a liquid crystal display as an optical filter in front of a conventional screen in a vehicle to make the image displayed invisible for the driver's viewing angle range during travel but visible to the front-seat passenger.

SUMMARY

An object of the present invention is to increase the voltage range within which the liquid crystal cells of an active matrix liquid crystal display can be operated without corruption of the rendered image and in addition, to increase the application possibilities of such an active matrix liquid crystal display.

According to the present invention, this objective is attained in that the active matrix liquid crystal display of the aforementioned type has a correction device which distorts the gray-scale signals reaching the liquid crystal cells based on information concerning the typical dependence between the optical transparence of the liquid crystal cells and the voltage applied to them and as a function of the difference in potential between the gray-scale signals and the reference potential in such a manner that an at least approximately linear relationship arises between the optical transparence of the liquid crystal cells and the undistorted gray-scale signals.

The active matrix liquid crystal display of the present invention can thus also be operated within voltage ranges in which the transparence of the liquid crystal cells typically changes in a non-linear fashion as a function of the particular voltage applied to them without the occurrence of corruptions of the image rendering. This makes it advantageously possible to set optimum contrast ratios for specific viewing angle ranges via a largely unlimited selection of the voltage range and to better adjust the range within which the transparence of the liquid crystal cells is changed to display the gray-scale values to the background lighting.

The correction device can be connected to the column control unit, it distorting the gray-scale signals generated by the column control unit before they are output to the column electrodes. The signal distortion may be analog or digital depending on whether the gray-scale signal values are present in analog or digital form. The information concerning the typical dependency of the optical transparence of the liquid crystal cells on the applied voltage may be present in a memory as a characteristic curve or in the form of digital tabular values.

In an alternative embodiment of the active matrix liquid crystal display of the present invention, the correction device is connected to the row control unit, the row control unit changing the turn-on signals for the switches by controlling the turn-on times and turn-off times for the purpose of distorting the gray-scale signals transferred from the switches to the liquid crystal cells. In doing so, the integrating behavior of both the liquid crystal cells, which form individual capacitors, and of the human eye is used in that changing the relationship between the periodically successive turn-on and turn-off times of a liquid crystal cell activated with a specific gray-scale signal correspondingly changes the displayed or perceived gray-scale value.

Corresponding to a further development of the active matrix liquid crystal display of the present invention, it has an adjustment device for variably adjusting the difference in potential between the potential level of the gray-scale signals and the reference potential for at least a part of the columns. Changing the potential difference changes the viewing angle range within which the image displayed on the active matrix liquid crystal display is visible to the observer. Since the gray-scale values are distorted by the correction device as a function of the potential difference, its change does not result in a corruption of the image rendering. It is therefore possible in a like manner, as is known from the aforementioned U.S. Pat. No. 5,526,065, to mask out the displayed images in a vehicle in the viewing angle range of the driver while they are visible to the front-seat passenger; in contrast to the known methods, the image is rendered via the active matrix liquid crystal display which is by far better suited for use in vehicles than conventional screens due to, among other things, its smaller mounting depth. An additional possibility for use of the active matrix liquid crystal display of the present invention is the display of three-dimensional objects, different images of one and the same object being displayed in different viewing angle ranges which can be set.

In the simplest case, the adjustment device is designed for the variable adjustment of the reference potential.

As an alternative, the adjustment device can be designed for the variable adjustment of the potential level of the gray-scale signals, a variable offset voltage being superimposed, for example, on the analog gray-scale signals or a variable offset value being superimposed on the digital gray-scale signals.

To be able to display different images for different viewing angle ranges in an advantageous manner, according to the present invention the column control unit outputs the gray-scale signals of at least two different images interleaved chronologically in sequence to the column electrodes and the adjustment device sets different potential differences in sequence for the various images.

In an alternative embodiment of the active matrix liquid crystal display of the present invention, the column control unit outputs the gray-scale signals of at least two different images interleaved simultaneously column-by-column to the column electrodes and the adjustment device sets different potential differences at the column electrodes each assigned to different images.

The chronological interleaving and the spatial interleaving in the rendering of different images can also be combined. With the interleaved rendering of different images, it being possible, for example, to display traffic information to the driver in a vehicle and to present a video film to the front-seat passenger at the same time. In a like manner, it is possible to show different images (videos) via a single active matrix liquid crystal display to passengers sitting side-by-side in railroad cars or airplanes.

To further explain the invention in detail, reference will be made to the figures of the drawing in which:

DETAILED DESCRIPTION

Figure 1:
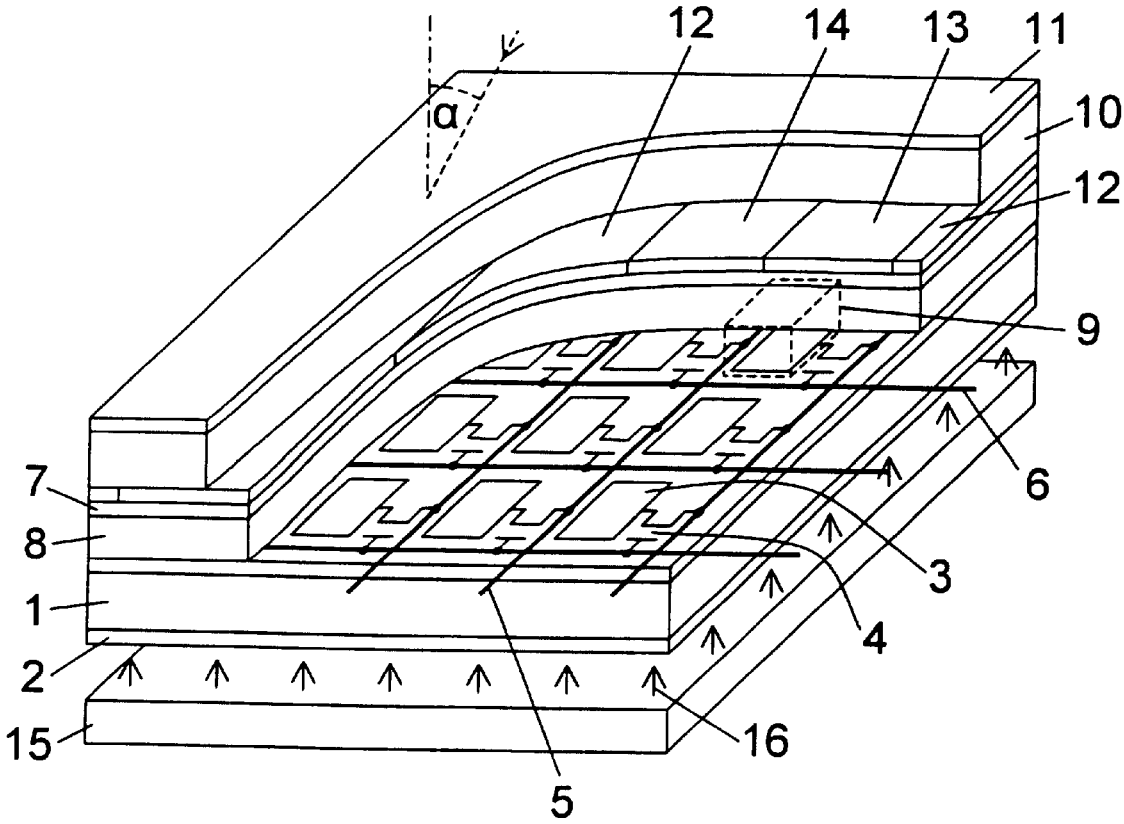
FIG. 1 shows an example of an active matrix liquid crystal display.

FIG. 1 shows an example of the configuration of an active matrix liquid crystal display without the associated control electronics. A lower glass plate 1 has a polarization film 2 on its underside. Light-transmitting pixel electrodes 3 are formed on the top of glass plate 1 in a row-column matrix, the pixel electrodes being connected to column electrodes 5 column-by-column via controllable switches 4 assigned to them individually and designed as thin film transistors. Controllable switches 4 are connected row-by-row to row electrodes 6 via their gate electrodes. Together with counter-electrode 7 and a liquid crystal bed 8 under it, which is common to all pixel electrodes 3, each light-transmitting pixel electrode 3 forms an activatable liquid crystal cell 9, resulting in a row and column-shaped arrangement of liquid crystal cells 9. The layer with liquid crystal cells 9 is covered by a top glass plate 10, to which an additional polarization film 11 is applied. To display color images, red, green and blue color filter strips 12, 13 and 14 are arranged alternately column-by-column between liquid crystal cells 9 and top glass plate 11.

For image rendering, light 16 is beamed via background lighting through the matrix having liquid crystal cells 9 and from there it is switched through via row and column electrodes 6 and 5 with varying brightness depending on activation. Light 16 is first polarized by lower polarization film 2 (polarizer). In individual liquid crystal cells 9, the liquid crystals are twisted as a function of the electrical voltage between the particular pixel electrode 3 and counter-electrode 7 so that the polarization direction of the light passing through the liquid crystal is correspondingly twisted. In upper polarization film 11 (analyzer), this twisting of the polarization direction results in a brightness reduction of the emerging light which brightness reduction is more or less intense as a function of the degree of twisting.

Figure 2:
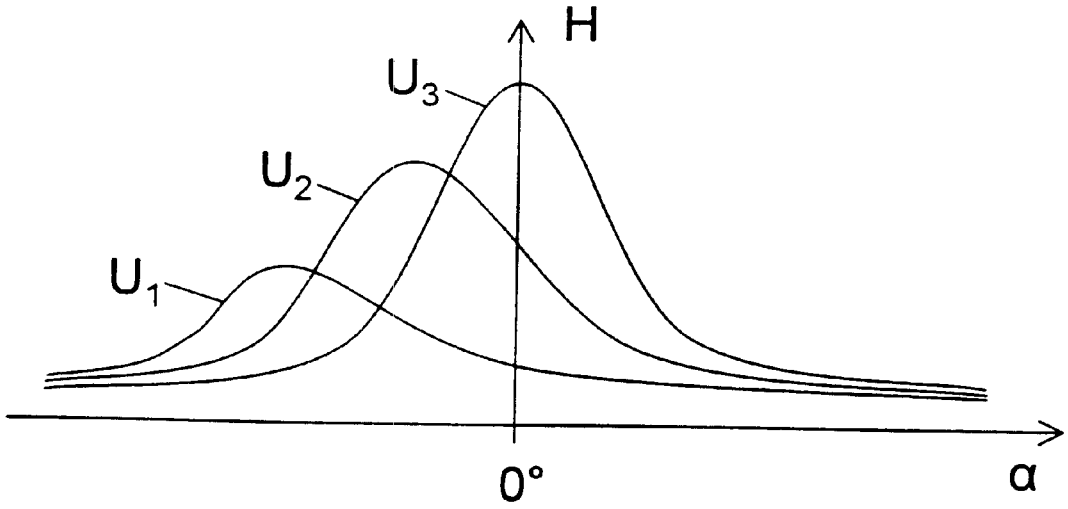
FIG. 2 shows an example of the dependence between the brightness or the gray-scale value of rendered pixels on the viewing angle.

As FIG. 2 shows, brightness H of the light emerging from the active matrix liquid crystal display and accordingly the contrast of the particular image displayed is dependent on viewing angle a. Moreover, this dependence also varies with voltage U, in this case, for example, three different voltages $U_1$, $U_2$ and $U_3$ applied to the particular liquid crystal cell 9.

Figure 3:
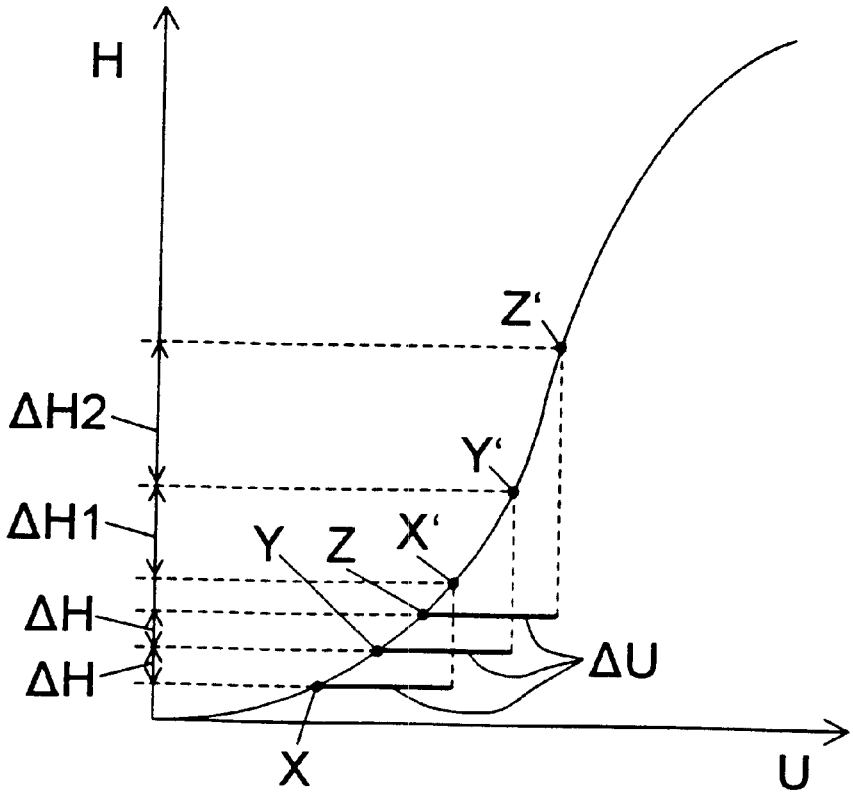
FIG. 3 shows an example of the non-linear dependence between the brightness of a pixel or the optical transparence of a liquid crystal cell and the voltage applied to it.
Figure 4:
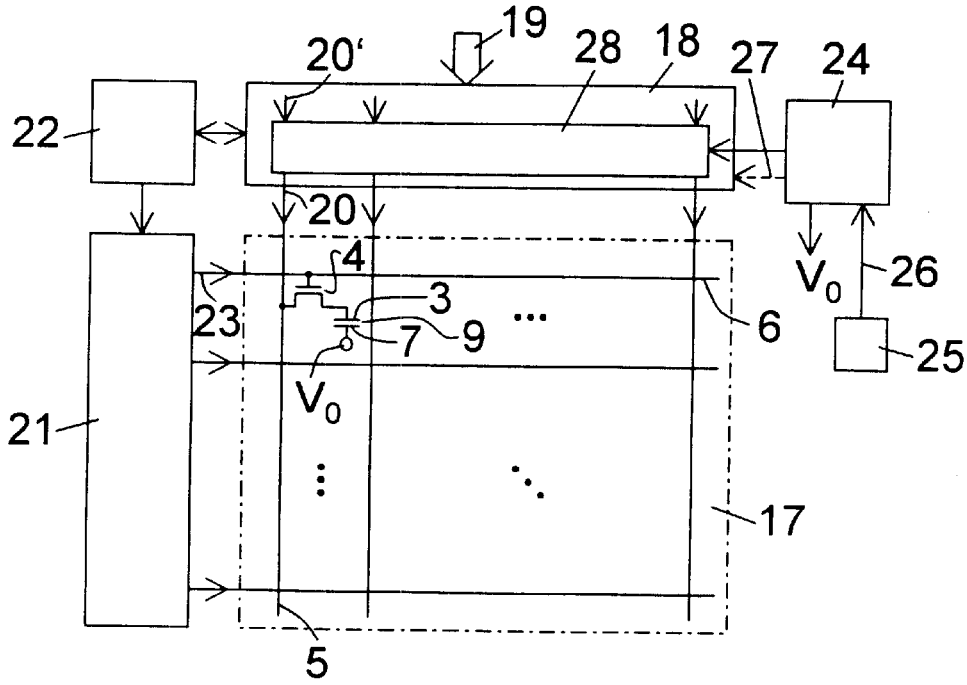
FIG. 4 shows an embodiment of the active matrix liquid crystal display of the present invention.

FIG. 3 shows qualitatively the typically non-linear dependence between brightness H or synonymously the optical transparence of liquid crystal cells 9 and the particular voltage U applied to them. Ordinarily, liquid crystal cells 9 are operated in a voltage range in which this dependence is largely linear. In the non-linear ranges, it is possible, as is explained below, for corruptions of the image rendering to occur. For example, three pixels X, Y and Z are observed which are simultaneously generated by three different liquid crystal cells 9, pixel Z being one amount $\Delta H$ brighter than pixel Y which is in turn brighter than pixel X by the same amount. If the voltages applied to the three liquid crystal cells 9 are now changed by the same amount $\Delta U$, the brightness difference between pixels X, Y and Z changes in a non-linear manner, a brightness difference $\Delta H1$ being generated between new pixels X' and Y' and a brightness difference $\Delta H2$ which is different from it being generated between new pixels Y' and Z'. This brightness corruption is particularly noticeable in the form of color corruptions in the rendering of color images and is accordingly even more annoying than with pure gray-scale image rendering FIG. 4 shows an embodiment of the active matrix liquid crystal display of the present invention in the form of a block diagram. In matrix 17, liquid crystal cells 9 shown here as capacitors are arranged in rows and columns. On the side formed by pixel electrodes 3, liquid crystal cells 9 are connected column-by-column to column electrodes 5 via controllable switches 4 assigned to them individually. On the control side, switches 4 are connected row-by-row to row electrodes 6. Counter-electrode 7 common to all liquid crystal cells 9 is connected to a reference potential $V_0$.

Column electrodes 5 are connected to a column control unit 18 which, on the basis of image signals 19 supplied to it, simultaneously generates different gray-scale signals 20 for the various columns of liquid crystal cells 9 and generates different gray-scale signals 20 for liquid crystal cells 9 in chronological succession in the various rows and applies them to column electrodes 5. A row control unit 21 activates controllable switches 4 via row electrodes 6 in such a way that gray-scale signals 20 at column electrodes 5 are switched through in succession to the rows with liquid crystal cells 9. A synchronizing device 22 connected to both control units 18 and 21 synchronizes chronologically successive gray-scale signals 20 for the various rows with liquid crystal cells 9 and synchronizes turn-on signals 23 for the individual rows. For color image rendering, the three adjacent liquid crystals 9, each located behind the various color filter strips 12, 13 and 14 (FIG. 1), are combined into a color pixel made up of three sub-pixels with regard to their activation.

To be able to change the viewing angle range within which the image displayed by matrix 17 with liquid crystal cells 9 is visible to the observer, the difference in potential between reference potential $V_0$ at counter-electrode 7 and the potential level of gray-scale signals 20 switched through to pixel electrodes 3 can be adjusted. This purpose is served by an adjustment device 24 which changes reference potential $V_0$ as a function of an adjustment signal 26 generated, in this case for example, manually via a control element 25. As suggested by signal path 27, shown as a dashed line, the potential level of gray-scale signals 20 can also be changed as an alternative to changing reference potential $V_0$ by superimposing a variable offset voltage or a variable offset value in the case of digital gray-scale signals.

Column-control unit 18 contains a correction device 28, to which adjustment device 24 reports the presently adjusted reference potential $V_0$. Gray-scale signals 20' are distorted, based on information concerning the typical dependence between the optical transparence of liquid crystal cells 9 and the voltage applied to them shown in FIG. 3 and in dependence on the potential difference between gray-scale signals 20' and reference potential $V_0$ in correction device 28, before being applied to column electrodes 5, in such a way that an at least approximately linear relationship results between the optical transparence of liquid crystal cells 9 and undistorted gray-scale signals 20'.

Figure 5:
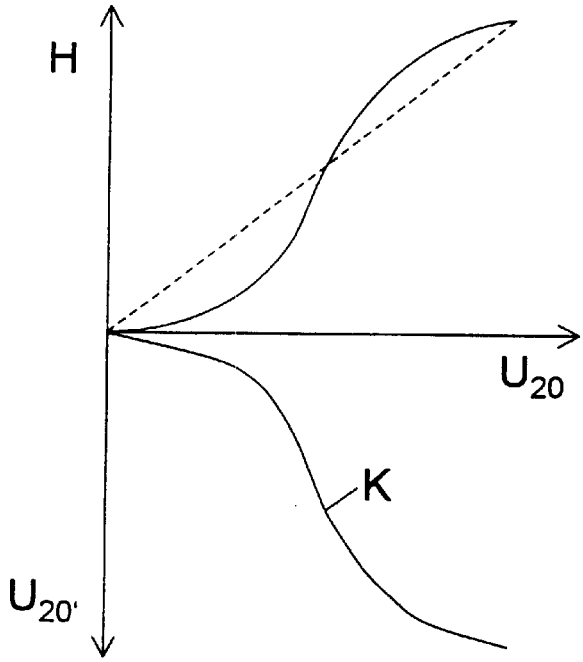
FIG. 5 shows an example of the distortion of the gray-scale signals.

FIG. 5 shows once more the typically non-linear dependence between brightness H or synonymously the optical transparence of liquid crystal cells 9 and voltage $U_{20}$ applied to them in each case, voltage $U_{20}$ corresponding to the potential difference between gray-scale signals 20 and reference potential $V_0$. Moreover, a characteristic curve K is shown, corresponding to which undistorted gray-scale signals 20' with voltage $U_{20}$ are converted into distorted gray-scale signals 20 with voltage $U_{20}$ in correction device 28. The conversion may also occur digitally, characteristic curve K then being present in the form of a table of values in a memory which is not shown here.

Figure 6:
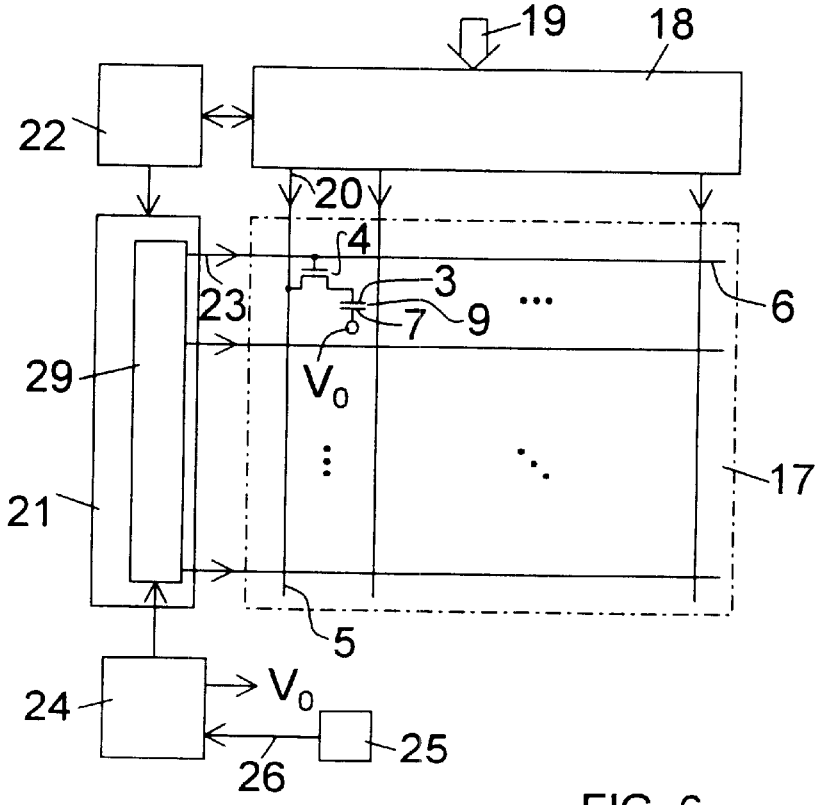
FIG. 6 shows an additional embodiment of the active matrix liquid crystal display of the present invention.
Figure 7:
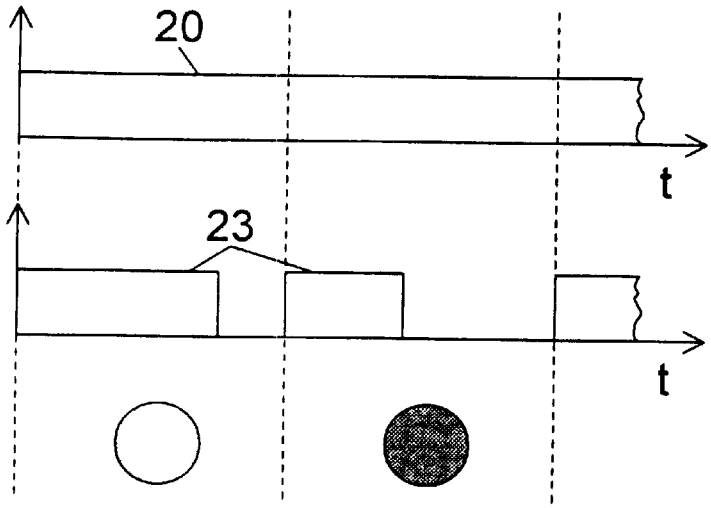
FIG. 7 shows an additional example of the distortion of the gray-scale signals.

The embodiment of the active matrix liquid crystal display of the present invention shown in FIG. 6 differs from that of FIG. 4 in that correction device 29 is a component of row control unit 21 or is assigned to it. As shown in FIG. 7, turn-on signals 23 for controllable switches 4 are changed by controlling the turn-on and turn-off times for the purpose of distorting gray-scale signals 20 switched through to liquid crystal cells 9. The integrating behavior of both liquid crystal cells 9 and the human eye causes the display of the same gray-scale 20 to be darker as the turn-on time becomes shorter. The turn-on and turn-off times can be controlled using a characteristic curve such as the one shown in FIG. 5.

Figure 8:
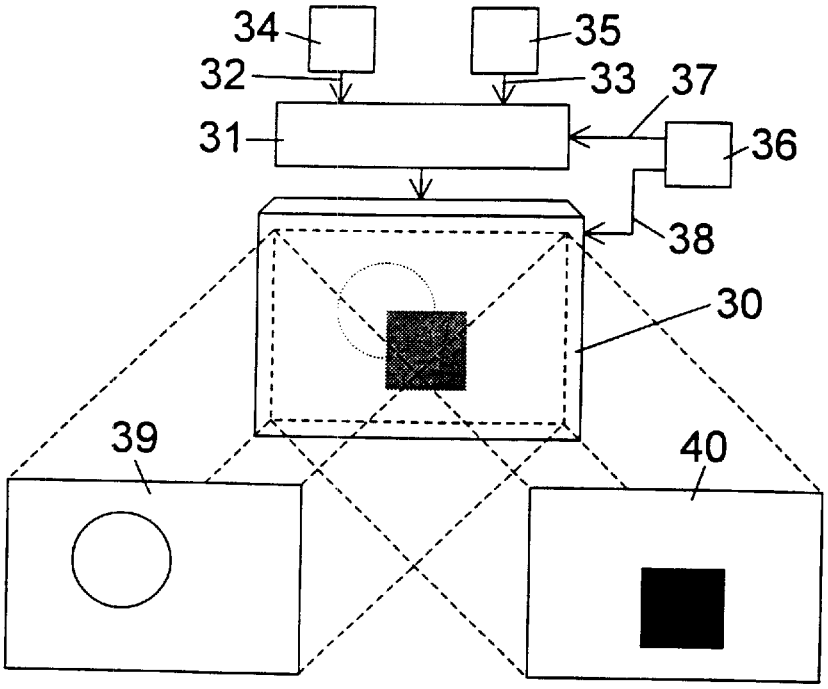
FIGS. 8 to 10 show various examples for the use of the active matrix liquid crystal display of the present invention and FIG. 11 shows an example of the installation of the active matrix liquid crystal display in a vehicle.

In the embodiment shown in FIG. 8, image signals 32 and 33 from two different image signal sources 34 and 35 are supplied to active matrix liquid crystal display 30 shown in FIG. 4 or 6 via a controllable switchover device 31 which is a component of column control unit 18. Switchover device 31 is controlled by an adjustment device 36 with a periodically alternating switchover signal 37. Simultaneously, adjustment device 36 supplies two reference potentials, which alternate synchronously with switchover signal 37, to counter-electrode 7 of active matrix liquid crystal display 30 via a signal link 38. Images 39 and 40 generated on the basis of image signals 32 and 33 from active matrix liquid crystal display 30 are therefore displayed separately in different viewing angle ranges.

Figure 9:
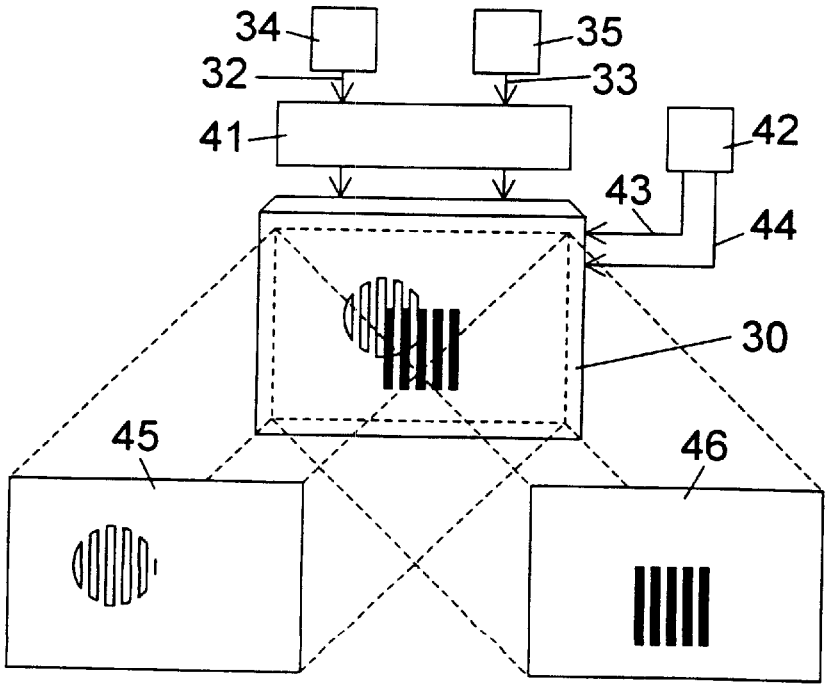

In the alternative embodiment shown in FIG. 9, the different image signals 32 and 33 of image signal sources 34 and 35 are supplied to active matrix liquid crystal display 30 via a signal processing device 41 which is a component of column control unit 18. Signal processing device 41 interleaves image signals 32 and 33 column-by-column so that gray-scale values 20 belonging to different images are supplied to adjacent column electrodes 5. Simultaneously, an adjustment device 42 generates two different offset voltages or offset values 43 and 44 and supplies them to active matrix liquid crystal display 30 where, interleaved column-by-column, they are superimposed on gray-scale signals 20 output to column electrodes 5. Images 45 and 46 generated by active matrix liquid crystal display 30 on the basis of image signals 32 and 33 are therefore displayed interleaved column-by-column in different viewing angle ranges.

Figure 10:
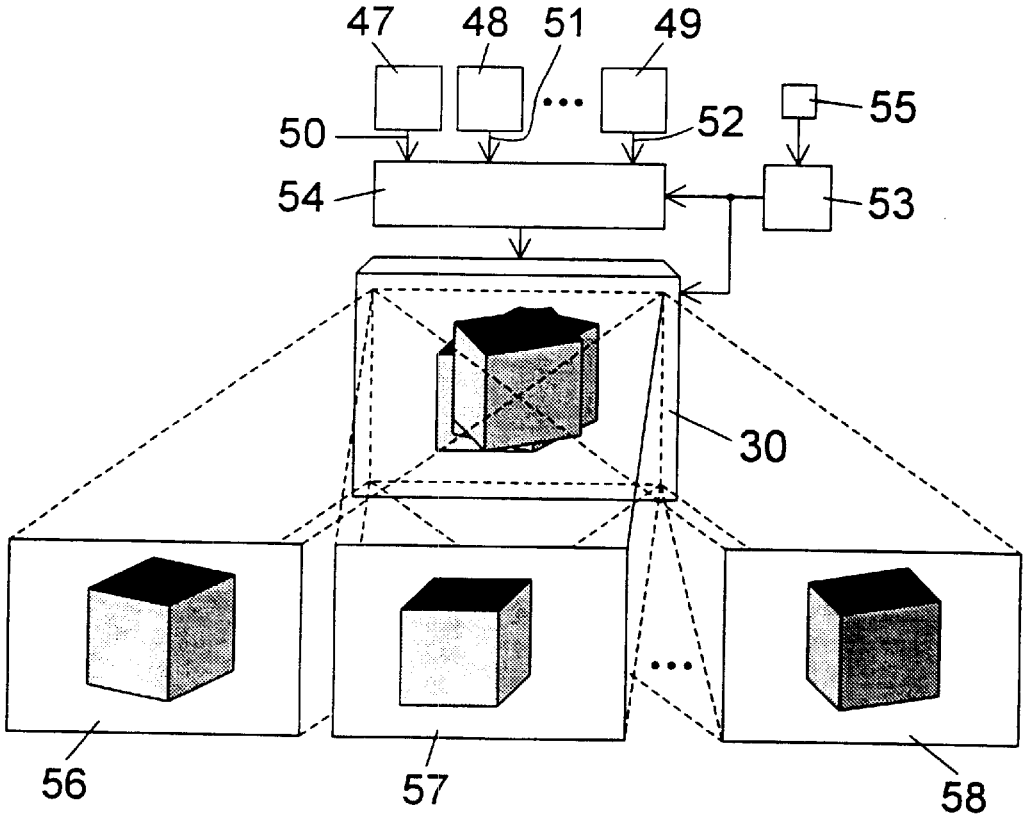

FIG. 10 shows an embodiment in which several image signal sources 47, 48 and 49 supply image signals 50, 51 and 52 of different views of a three-dimensional object. Image signals 50, 51 and 52 are supplied to active matrix liquid crystal display 30 via a switchover device 54 controlled by an adjustment device 54. Via an operating element 55, adjustment device 53 can be used to gradually set different reference potentials for counter-electrode 7 of active matrix liquid crystal display 30, one reference potential for counter-electrode 7 of active matrix liquid crystal display 30 being assigned to each image signal 50, 51 and 52 switched through to active matrix liquid crystal display 30. The result of this is that active matrix liquid crystal display 30 generates different images 56, 57 and 58 which display the three-dimensional object in different views for different viewing angle ranges, thus resulting in a three-dimensional display of the object.

Figure 11:
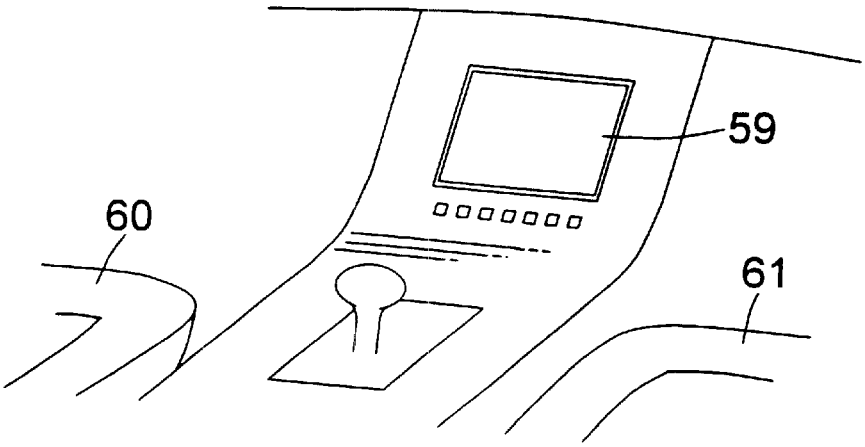

Finally, FIG. 11 shows an example of the installation of active matrix liquid crystal display 59 in a vehicle, centered roughly in front of driver's seat 60 and passenger's seat 61.

What is claimed is:

1. An active matrix liquid crystal display, comprising:

pixels formed by liquid crystal cells arranged in rows and columns of a matrix, a first side of the liquid crystal cells being connected to a reference potential;

controllable switches, a control side of the controllable switches being connected row-by-row to row electrodes, a second side of the liquid crystal cells being connected column-by-column to column electrodes via a respective one of the controllable switches;

a column control unit to generate gray-scale signals for the columns, the column electrodes being connected to the column control unit;

a row control unit to generate turn-on signals for the controllable switches, the row electrodes being connected to the row control unit;

a correction device that distorts the gray-scale signals reaching the liquid crystal cells based on information relating to a typical dependence between an optical transparence of the liquid crystal cells and a voltage applied so that an at least approximately linear relationship results between the optical transparence of the liquid crystal cells and undistorted gray-scale signals; and an adjustment device to variably adjust a potential difference between a.potential level of the gray-scale signals and the reference potential for at least one part of the columns, the gray-scale signals being distorted by the correction device as a function of the potential difference between the potential level of the gray-scale signals and the reference potential, the adjustment device for one of: i) changing a viewing angle range, and ii) adjusting optical contrast ratios within a specific viewing angle range;

wherein the correction device is assigned to the row control unit and changes the turn-on signals for the controllable switches by controlling turn-on and turn-off times to distort the gray-scale signals transferred by the controlled switches to the liquid crystal cells.

2. The active matrix liquid crystal display according to claim 1, wherein the adjustment device variably adjusts the reference potential.

3. The active matrix liquid crystal display according to claim 1, wherein the adjustment device variably adjusts the potential level of the gray-scale signals.

4. The active matrix liquid crystal display according to claim 1, wherein the column control unit outputs the gray-scale signals, from at least two different images interleaved in succession, to the column electrodes, and wherein the adjustment device sets different potential differences in succession for the different images.

5. The active matrix liquid crystal display according to claim 1, wherein the column control unit outputs the gray-scale signals from at least two different images, which are simultaneously interleaved column-by-column, to the column electrodes, the adjustment device applying different potential differences to the column electrodes assigned to the different images.

6. The active matrix liquid crystal display according to claim 1, wherein the active matrix liquid crystal display is arranged in a vehicle approximately centered in from of laterally adjacent passenger seats.

* * * * *